US011268283B2

(12) United States Patent
Shetler

(10) Patent No.: US 11,268,283 B2
(45) Date of Patent: Mar. 8, 2022

(54) SPRAYING AND SEAMING ASSEMBLY

(71) Applicant: Shetler Construction, LLC, LaGrange, IN (US)

(72) Inventor: James Shetler, LaGrange, IN (US)

(73) Assignee: Shetler Construction, LLC, LaGrange, IN (US)

( * ) Notice: Subject to any disclaimer, the term of this patent is extended or adjusted under 35 U.S.C. 154(b) by 191 days.

(21) Appl. No.: 16/739,186

(22) Filed: Jan. 10, 2020

(65) Prior Publication Data

US 2020/0232222 A1 Jul. 23, 2020

Related U.S. Application Data

(60) Provisional application No. 62/793,676, filed on Jan. 17, 2019.

(51) Int. Cl.

| | |
|---|---|
| ***B05B 9/00*** | (2006.01) |
| ***B05B 13/00*** | (2006.01) |
| ***B05B 15/60*** | (2018.01) |
| ***E04D 15/07*** | (2006.01) |
| ***B05C 5/02*** | (2006.01) |

(52) U.S. Cl.

CPC ..... *E04D 15/07* (2013.01); *B05B 9/007* (2013.01); *B05B 13/005* (2013.01); *B05B 15/60* (2018.02); *B05C 5/027* (2013.01)

(58) Field of Classification Search

CPC ..... B05B 13/005; B05B 9/007

See application file for complete search history.

(56) References Cited

U.S. PATENT DOCUMENTS

| | | | | |
|---|---|---|---|---|
| 4,828,177 | A * | 5/1989 | Schuitemaker | A01M 7/0035 239/165 |
| 4,932,354 | A * | 6/1990 | Kistner | B05B 16/80 118/305 |
| 5,114,268 | A * | 5/1992 | Marcato | E01C 23/22 404/101 |
| 5,201,953 | A * | 4/1993 | Lowry | B05B 13/005 118/305 |
| 5,312,043 | A * | 5/1994 | Whitney | B05B 13/005 239/176 |
| 6,062,443 | A * | 5/2000 | Smrt | B05B 9/007 222/608 |
| 7,367,515 | B1 * | 5/2008 | Newman | E01C 23/22 222/608 |
| 2005/0013942 | A1 * | 1/2005 | Rich | B05B 13/005 118/308 |
| 2011/0031270 | A1 * | 2/2011 | Choiniere | B29B 7/7447 222/1 |
| 2013/0008376 | A1 * | 1/2013 | Snowwhite | B05B 13/005 118/612 |
| 2013/0236644 | A1 * | 9/2013 | Logan | B05B 13/005 118/313 |
| 2019/0100888 | A1 * | 4/2019 | Hand | B05B 9/007 |

* cited by examiner

*Primary Examiner* — Binu Thomas

(74) *Attorney, Agent, or Firm* — Marshall & Melhorn, LLC

(57) ABSTRACT

A combined roof spraying and seaming assembly that is easy, safe, and efficient to operate. The assembly is able to provide consistent coating thickness to the surface of a roof, while being able to fully coat all surfaces on the roof. The assembly can readily seam various types of roof surface conditions, such as those having channeled, corrugated, and/or ribbed surfaces.

10 Claims, 6 Drawing Sheets

SPRAYING AND SEAMING ASSEMBLY

CROSS REFERENCE TO RELATED APPLICATIONS

The present application claims the benefit to U.S. Provisional Patent Application No. 62/793,676 filed on Jan. 17, 2019, which is incorporated herein by reference in its entirety.

FIELD

The present disclosure relates to an adjustable spraying and seaming assembly for use on a roof.

BACKGROUND

Roofs, particularly metal roofs, need to be regularly maintained in order to prevent leaks, cracks, and deterioration. Some of the regular maintenance includes painting/coating of the roof. Commonly used methods for painting roofs include manually applying paint through brushes, sprayers, and the like. However, these techniques are slow and labor intensive, requiring a number of individuals to be on the roof at the same time. In addition to being inefficient, these techniques present increased safety risks to the individuals on the roof.

Commonly used spraying/coating methods and assemblies often result in inconsistent coating of the roof. Many of these assemblies do not allow the spraying tips to be readily adjusted or controlled. As a result, these assemblies need to be continuously adjusted and rearranged. These assemblies still fail to coat certain areas on a roof, such as channeled, corrugated, or ribbed surfaces.

Consequently, there is a need for a combined roof spraying and seaming assembly that is easy, safe, and efficient to operate, provides consistent coating thickness to the surface of the roof, and that is able to fully coat all surfaces on the roof.

SUMMARY

What is provided is a combined roof spraying and seaming assembly that is easy, safe, and efficient to operate. The assembly is able to provide consistent coating thickness to the surface of a roof, while being able to fully coat all surfaces on the roof.

In an embodiment, the assembly includes a pair of front wheels connected together by a front axle and a pair of rear wheels connected together by a rear axle. The assembly also includes a frame connected to each of the rear axle and the front axle through one or more connecting members, the frame having a handle; a first lower parallel member and an opposing second lower parallel member, wherein the first and second lower parallel members are interconnected by a first set of opposing end tubes; a first set of upright tubes extending vertically from the first lower parallel member to a first upper parallel member and a second set of upright tubes extending vertically from the second lower parallel member to a second upper parallel member; and a second set of opposing end tubes interconnecting the first upper parallel member with the second upper parallel member. The assembly further includes a first arm mounted to a joint, wherein the joint is rotatably mounted to one of the first set of upright tubes; one or more spray tubes removably mounted to the first arm, wherein the spray tubes are connected to a manifold mounted to the first upper parallel member via one or more hoses; one or more spray tips connected to the one or more spray tubes; a second arm pivotally mounted to the first lower parallel member; and a roller axle connected to the second arm, wherein a roller is rotatably mounted on the roller axle.

In some embodiments, the assembly further includes one or more stabilizers positioned on the first arm, wherein the one or more stabilizers are positioned in front of the roller.

In some embodiments, the assembly further includes a windscreen selectively attached to the first arm, wherein the windscreen fully surrounds the spray tips.

In some embodiments, the assembly further includes a battery or an electric motor.

BRIEF DESCRIPTION OF THE DRAWINGS

The above, as well as other advantages of the present disclosure, will become readily apparent to those skilled in the art from the following detailed description when considered in light of the accompanying drawings in which.

DETAILED DESCRIPTION

Figure 1:
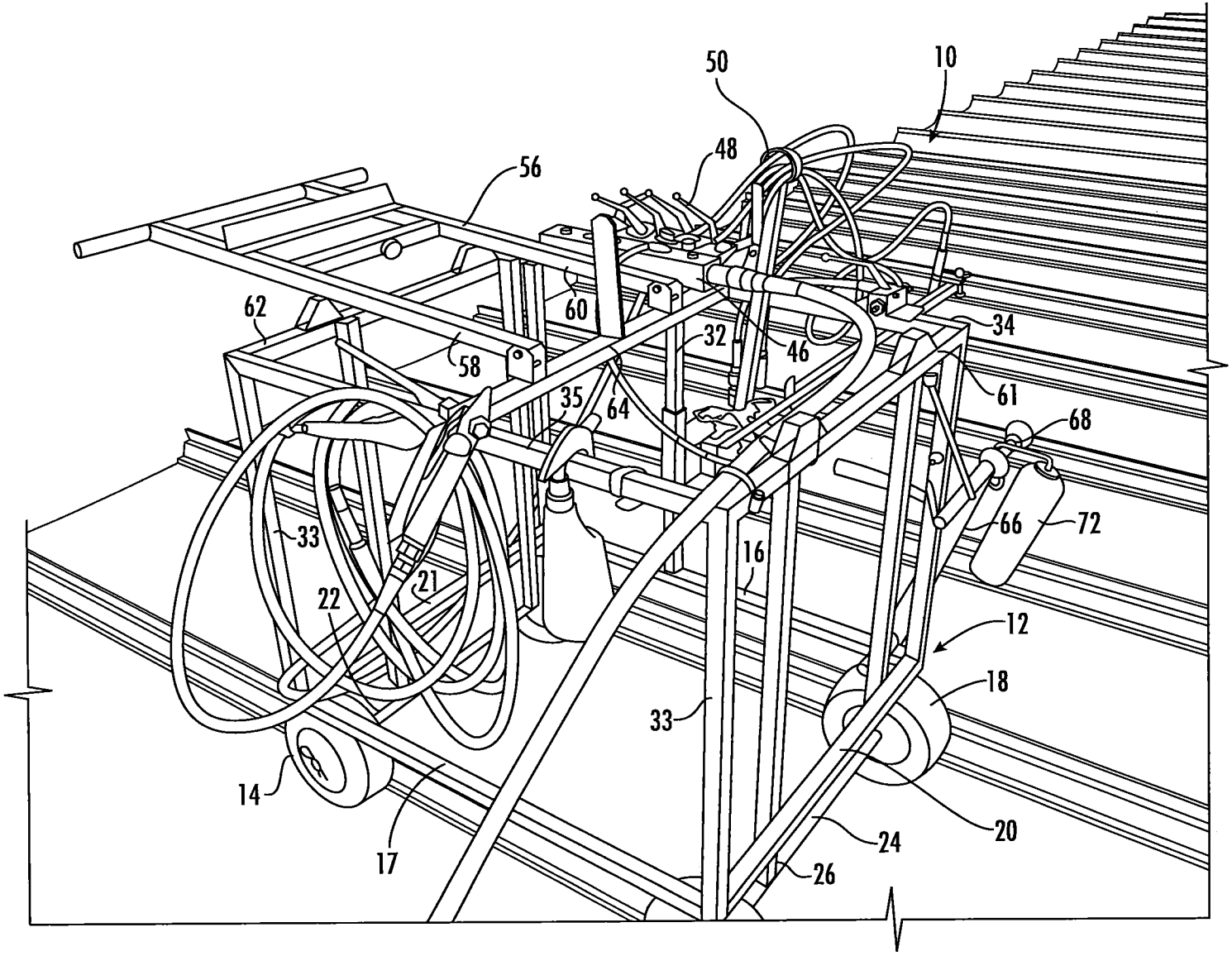
FIG. 1 is a schematic perspective view of a spraying and seaming assembly atop a roof according to an embodiment of the disclosure.

It is to be understood that the disclosure may assume various alternative orientations and step sequences, except where expressly specified to the contrary. It is also understood that the specific devices and processes illustrated in the attached drawings, and described in the specification are simply exemplary embodiments of the inventive concepts disclosed and defined herein. Hence, specific dimensions, directions or other physical characteristics relating to the various embodiments disclosed are not to be considered as limiting, unless expressly stated otherwise.

FIGS. 1-4 provide schematic views of a spraying and seaming assembly 10 according to an embodiment of the disclosure for spraying and seaming material onto a non-vertical surface, such as a roof. The spraying and seaming assembly 10 includes a frame 12 having a pair of front wheels 14 rotatably mounted thereto and a pair of rear wheels 18 rotatably mounted thereto. The front wheels 14 and the rear wheels 18 allow movement of the frame 12 across the roof. The front wheels 14 and the rear wheels 18 may each be air tires and/or made of rubber.

The rear wheels 18 are connected together by a rear axle 22. The front wheels 14 are connected together by a front axle 24. The rear axle 22 and the front axle 24 are each fixably connected to the frame 12 through one or more connecting members 26. As a result, the connecting members 26 are positioned perpendicular to each of the rear axle 22 and the front axle 24.

Figure 2:
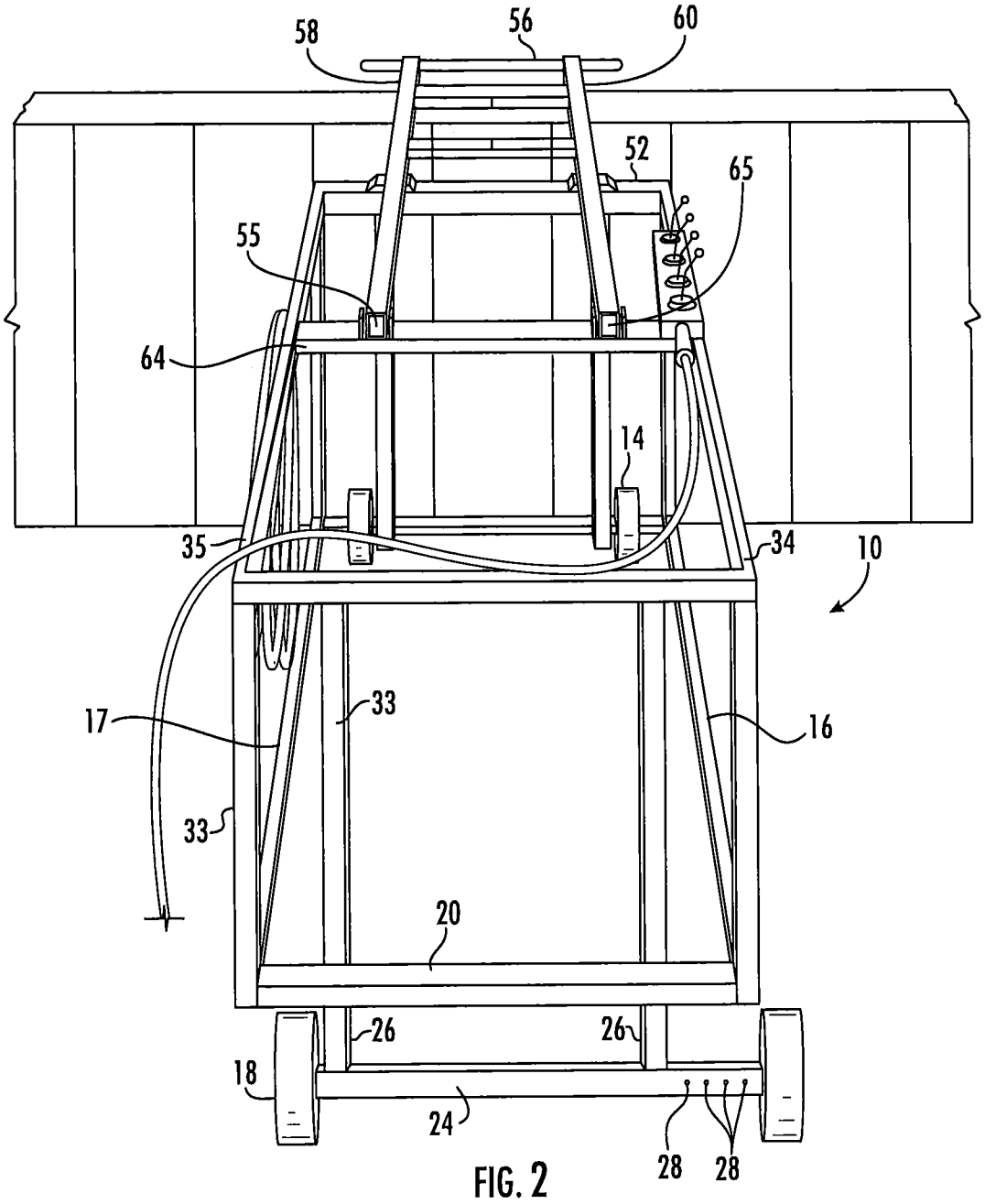
FIG. 2 is a schematic rear perspective view of the spraying and seaming assembly illustrated in FIG. 1.

As best seen in FIG. 2, each of the rear axle 22 and the front axle 24 have one or more holes 28 for receiving one or more pins (not shown) to control the spacing of the rear wheels 18 and the front wheels 14 with respect to the frame 12. Thus, the spacing of the rear wheels 18 and the front wheels 14 may be controlled by moving one or more of the rear wheels 18 and one or more of the front wheels 14 along the rear axle 22 and the front axle 24, respectively. The adjustable spacing of the rear wheels 18 and the front wheels 14 allows the spraying and seaming assembly 10 to be readily moved over various locations on roof panels, including those having channeled, corrugated, and/or ribbed surfaces.

As best seen in FIGS. 1 and 2, the frame 12 includes a first lower parallel member 16 and an opposing second lower parallel member 17, wherein the first lower parallel member 16 and the second lower parallel member 17 are each connected at their ends to opposing end tubes 20 and 21.

The frame 12 also includes a first set of upright tubes 32 extending vertically from the first lower parallel member 16 to a first upper parallel member 34 and a second set of upright tubes 33 extending vertically from the second lower parallel member 17 to a second upper parallel member 35. The first set of upright tubes 32 are positioned opposite from the second set of upright tubes 33. Opposing end tubes 61, 62 connect the first upper parallel member 34 and the second upper parallel member 35 together. The end tubes 61, 62 are perpendicular to the first upper parallel member 34 and the second upper parallel member 35.

As best seen in FIG. 1, a cross member 64 may extend between and is connected to the first upper parallel member 34 and the second upper parallel member 35. The cross member 64 may be interposed between the end tubes 61, 62 on the frame 12.

In a non-limiting example and as shown in FIGS. 1 and 2, each of the first set of upright tubes 32 and the second set of upright tubes 33 have three tubes. In other embodiments, the number of tubes in the first set of upright tubes 32 and the second set of upright tubes 33 may be either less than three or more than three.

Figure 3:
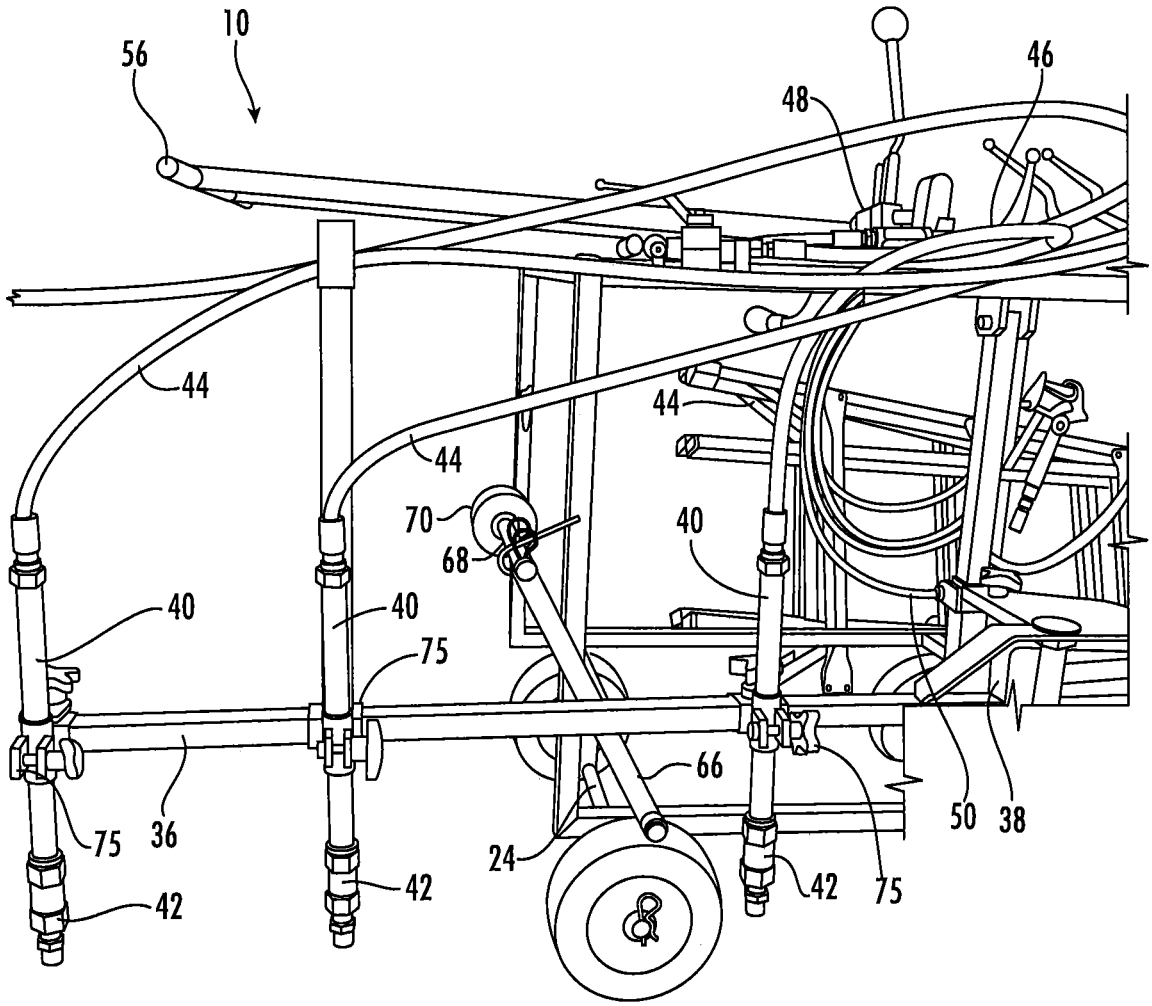
FIG. 3 is a schematic side perspective view of the spraying and seaming assembly illustrated in FIGS. 1 and 2.
Figure 4:
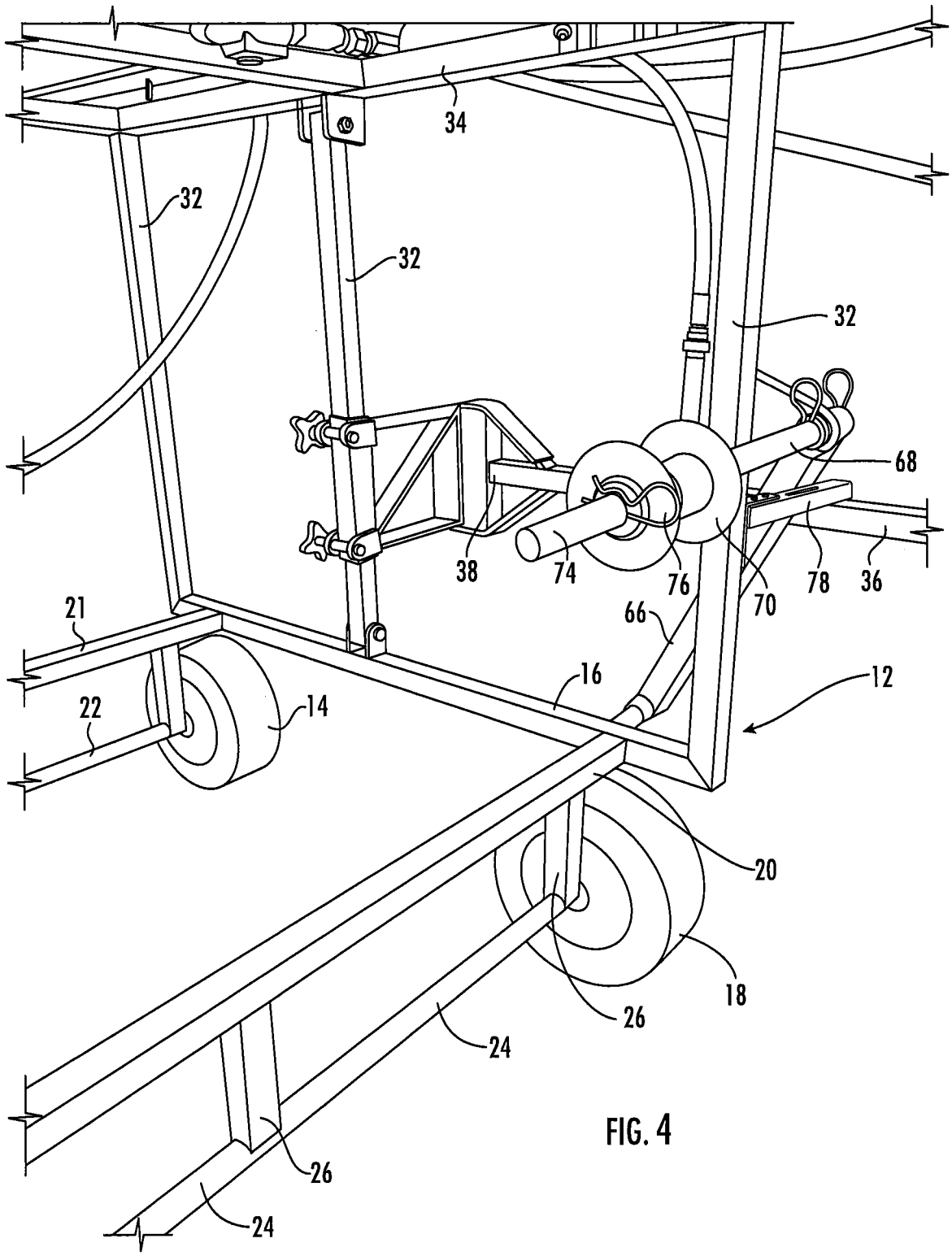
FIG. 4 is a schematic perspective view of an interior portion of the spraying and seaming assembly illustrated in FIGS. 1-3.

As best seen in FIGS. 3 and 4, a first arm 36 is fixedly mounted to a joint 38, wherein the joint 38 is rotatably mounted to an outer end of one of the first set of upright tubes 32. The joint 38 may be a hinge joint, a knuckle joint, a bracket, or the like. The joint 38 may comprise a variety of shapes and configurations. As a result, the first arm 36 may be pivotedly adjusted depending on the intended use of operation. For example, the first arm 36 may be extended away from one side of the spraying and seaming assembly 10 when in use such that the first arm 36 is substantially perpendicular to the first set of upright tubes 32. In another example, the first arm 36 may be substantially parallel to the first set of upright tubes 32 when the spraying and seaming assembly 10 is not in use.

Figure 5:
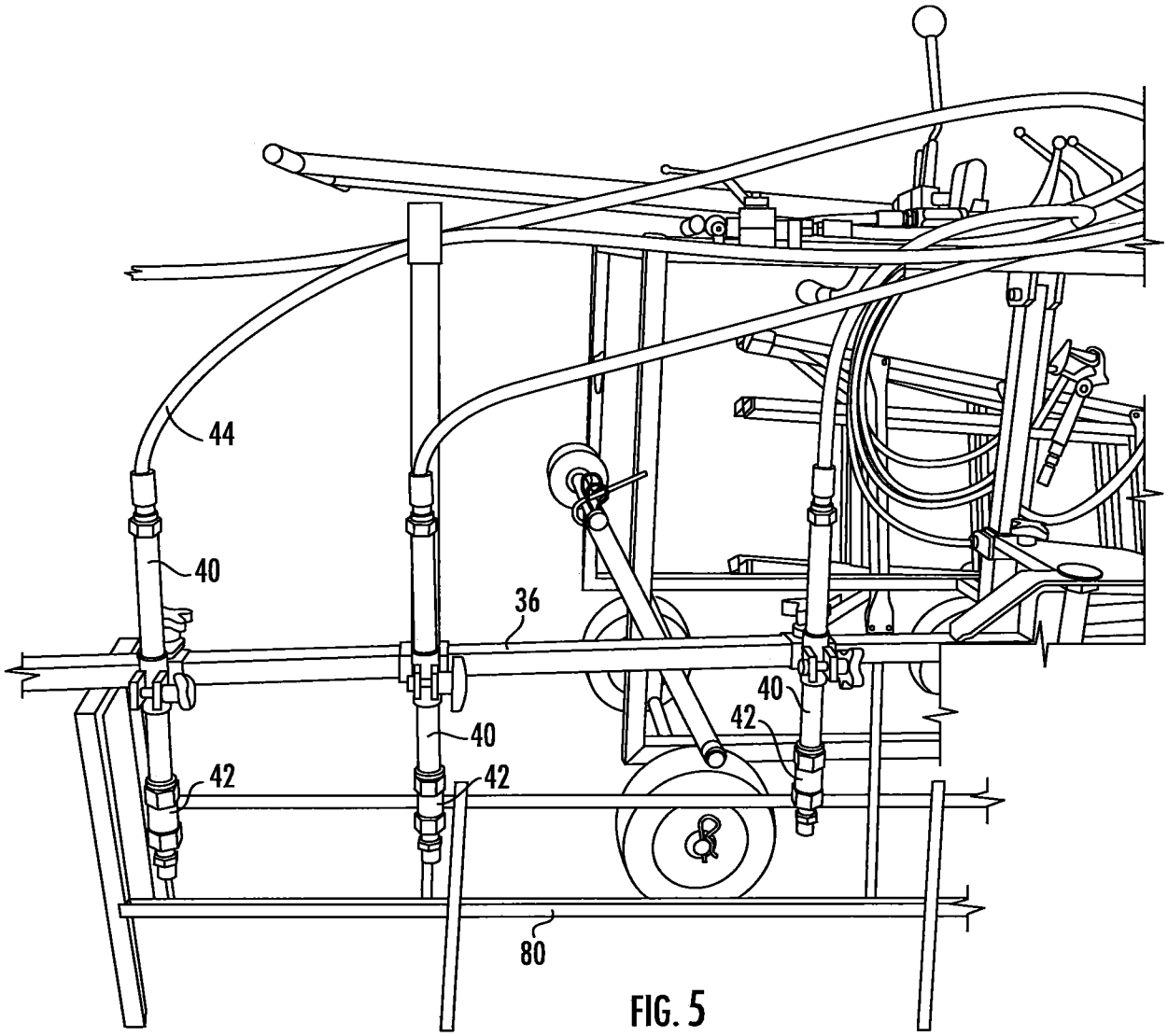
FIG. 5 is a schematic side perspective view of the spraying and seaming assembly illustrated in FIGS. 1-4 with a windscreen.

As best seen in FIGS. 3 and 5, one or more spray tubes 40 may be removably mounted to the outside of the first arm 36. Any technique for mounting the spray tubes 40 to the first arm 36 may be used such as clamping or latching using conventional fastening mechanisms. One or more spray tips 42 may be connected to the bottom ends respectively of the one or more spray tubes 40. The first arm 36 may be slidably adjusted outward or inward from the spraying and seaming assembly 10 to control the spacing and positioning of the spray tubes 40, and, in turn, the spray tips 42. In some examples, there may be four spray tubes 40 and four spray tips 42 positioned on the first arm 36 depending on the amount of surface area to be coated.

The spray tubes 40 are mounted and locked to the first arm 36 such that the respective spray tips 42 are at a constant height from the surface being sprayed, such as a roof. By loosening fastening mechanisms 75 connecting the spray tubes 40 to the first arm 36, the spray tubes 40 may be moved vertically to adjust the spacing between the spray tips 42 and the surface being sprayed. Likewise, the fastening mechanisms 75 may be positioned at various locations along the first arm 36 to allow for spacing between the spray tips 42. Thus, by adjusting the spacing between the individual spray tubes 40 and the spacing between the spray tips 42 and the surface being sprayed, the spray pattern of the coating material applied to the surface may be controlled.

Upper portions of the spray tubes 40 are connected via respective hoses 44 to a manifold 46 fixedly mounted to the first upper parallel member 34. The manifold 46 may have a hand control 48, and may, in turn, be connected to a hose 50 extending outwardly to a pump (not shown) and/or a reservoir (not shown). The hand control 48 may be a conventional on/off valve allowing the pressurized coating within the reservoir to control the flow of the coating material through the spray tubes 40 and their respective spray tips 42. Since the coating material within the manifold 46 is under pressure, the pressurized coating material is applied equally to the hoses 44 and eventually to the spray tips 42.

A handle 56 includes a pair of downwardly extending members 58 and 60 having bottom ends 55, 65 mounted to the cross member 64, which provides rigidity to the handle 56. When the spraying and seaming assembly 10 is pushed in operation, the handle 56 is positioned over the front wheels 14 and resting on the end tube 61. The handle 56 is configured to be pivoted such that the handle 56 is positioned over the rear wheels 18 depending on which direction the spraying and seaming assembly 10 is to be pushed. The handle 56 may allow for an operator to easily push the spraying and seaming assembly 10 while walking in order to reduce any discomfort associated with conventional roof spraying devices. The direction of movement of the assembly 10 across the surface to be coated may be reversed by adjusting the handle 56.

The spraying and seaming assembly 10 also comprises a second arm 66 pivotably mounted to the first lower parallel member 16. The second arm 66 may be pivoted downward by a pivoting device at an angle toward the spraying surface from the end tube 20. The pivot angle of the second arm 66 is adjustable depending on the spraying surface (e.g., roof). The pivot angle of the second arm 66 may be adjusted by loosening and tightening the bolted connection between the second arm 66 and the first lower parallel member 16. In the embodiment shown in FIG. 4, the second arm 66 pivots at an angle with respect to the first lower parallel member 16.

The second arm 66 is connected to a roller axle 68 by a fastener, such as a nut, a bolt, a screw, a pin, a rivet, a snap-fit, a shrink-fit, and the like. A roller 72 may be rotatably mounted on the roller axle 68 in a cantilever manner outwardly from the second arm 66. In some examples, the roller 72 may be mounted on the roller axle 68 through a roller carrier 70, such as a spool carrier for added support and stability to the roller 72. The roller 72 provides the needed propulsion force while applying pressure to the target surface on the roof. The roller 72 may be made of an elastomeric/rubber material, a fabric material, and/or the like. As a result, the roller 72 may flex to contact and cover each and every area of the spraying surface having any shape or contoured surface. In this manner, coating is completely transferred and/or applied from the assembly 10 to the spraying surface. Also, the roller 72 may apply fabric, such as 38" fabric to the spraying surface.

As best shown in FIG. 4, the roller axle 68 includes a plurality of holes 74 to receive one or more pins, such as cotter pins 76, to control the positioning and the width of the roller 72 on the roller axle 68 depending on the surface to be seamed. Consequently, the assembly 10 can readily seam various types of roof surface conditions, such as those having channeled, corrugated, and/or ribbed surfaces. Most conventional roof spraying and seaming assemblies are unable to contact all of the areas of a spraying surface due to the irregularities in the surface.

As best shown in FIG. 4, the assembly 10 may also include one or more adjustable counter-balances/stabilizers 78 connected to the first arm 36 to aid in stabilizing any shifting experienced when using the spray tubes 40 and their respective spray tips 42 on a spraying surface.

In a non-limiting example, the assembly 10 includes one counter-balance/stabilizer 78 that is positioned in front of the roller axle 68. The counter-balance/stabilizer 78 may pivot along an axle such that the counter-balance/stabilizer 78 may be moved vertically. Unlike in many conventional spraying and seaming assemblies, the counter-balance/stabilizer 78 on the assembly 10 may be readily adjustable to compensate for sag. The counter-balance/stabilizer 78 may be removed and re-attached in a different position on the assembly 10 when the assembly 10 is being used for seaming of the spraying surface. In non-limiting examples, the counter-balance/stabilizer 78 may be an adjustable boom.

In another non-limiting examples, the assembly 10 may comprise two adjustable counter-balance/stabilizers 78. Each of the counter-balance/stabilizers 78 may be adjustable booms. The first counter-balance/stabilizer 78 may apply a base coat to the spraying surface, the roller 72 may then apply fabric to the base coat, and a second counter-balance/stabilizer 78 may spray the fabric located on the base coat. The roller 72 may be interposed between the first counter-balance/stabilizer 78 and the second counter-balance/stabilizer 78.

As best shown in FIG. 5, the assembly 10 may also include a windscreen 80 to surround and shield the spray tips 42 from wind and other elements. The windscreen 80 may be attached at multiple positions on the first arm 36, wherein the spray tips 42 are located between the two attachment positions. The windscreen 80 may be readily removed and attached to the first arm 36 depending on the environmental conditions. The windscreen 80 may be attached to the first arm 36 through the use of conventional fastening mechanisms, such as clamping, latching, etc. The windscreen 80 may comprise a frame and a wrap, such as 16" shrink wrap, wrapped around the frame of the windscreen 80.

While the assembly 10 has been described as applying elastomeric coating materials to a roof, it is to be understood that a variety of materials may be applied by the assembly 10. For example, paint may be provided within the reservoir to allow application of paint to a structure, such as a metal roof.

Figure 6:
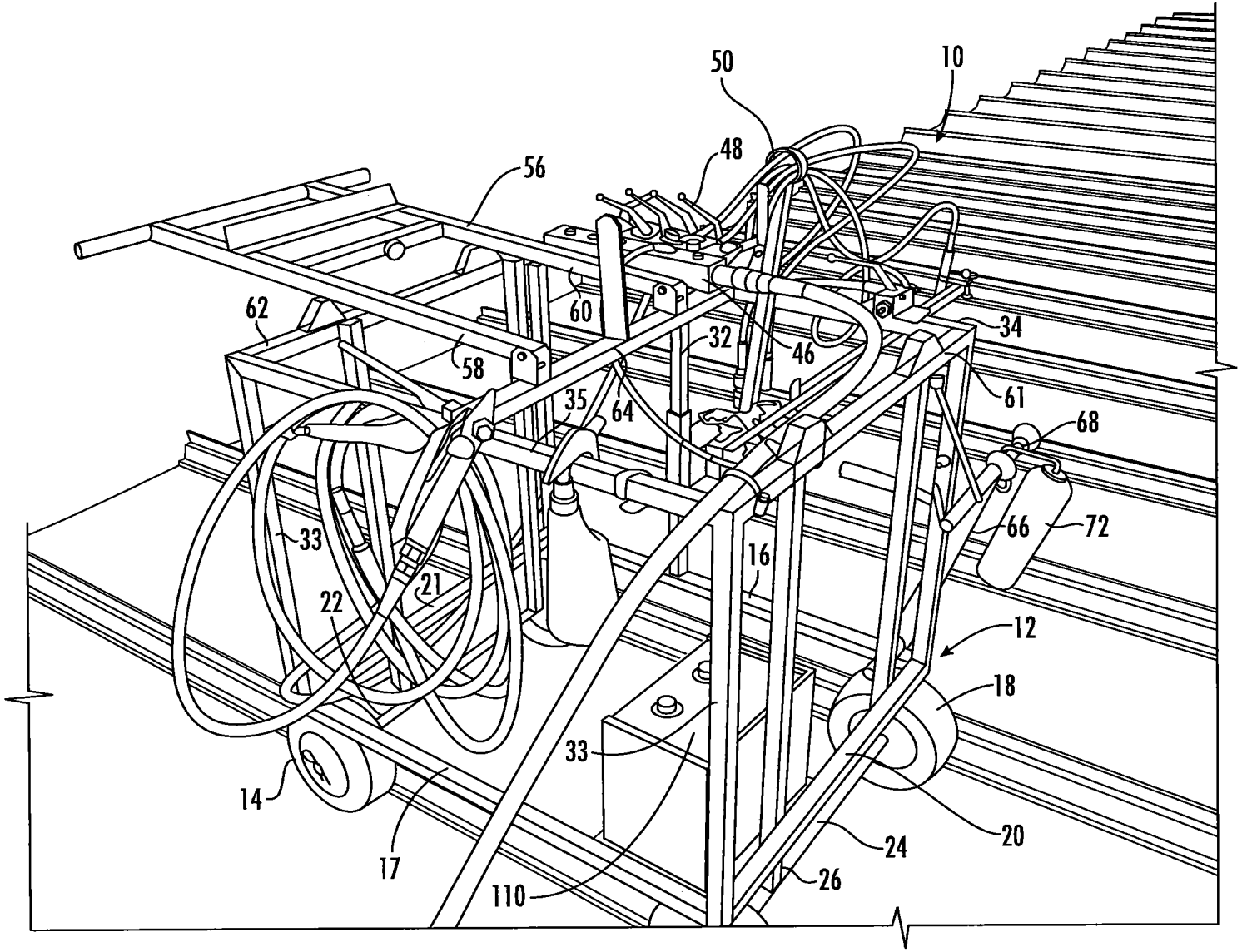
FIG. 6 is a schematic perspective view a spraying and seaming assembly according to an alternative embodiment of the disclosure.

FIG. 6 is a schematic perspective view of a spraying and seaming assembly 100 according to an alternative embodiment of the disclosure. FIG. 6 is the same as the spraying and seaming assembly 10 illustrated in FIGS. 1-5, except where specifically noted below. The assembly 10 may be self-propelled through the use of a battery 110 attached to the frame 12. The battery 110 may comprise any battery, such as an 18V battery or a 24V battery. In another alternative embodiment, the assembly 10 may be powered by an electric motor 120 attached to the frame 12.

In some embodiments, one or more components of the assembly 100 may be controlled through a remote controller. The remote controller provides for a safer way of operating the assembly 100 in order to reduce risks for operators of the assembly 100.

It is to be understood that the various embodiments described in this specification and as illustrated in the attached drawings are simply exemplary embodiments illustrating the inventive concepts as defined in the claims. As a result, it is to be understood that the various embodiments described and illustrated may be combined from the inventive concepts defined in the appended claims.

In accordance with the provisions of the patent statutes, the present disclosure has been described to represent what is considered to represent the preferred embodiments. However, it should be noted that this disclosure can be practiced in other ways than those specifically illustrated and described without departing from the spirit or scope of this disclosure.

What is claimed is:

1. An assembly comprising:

a pair of front wheels connected together by a front axle;

a pair of rear wheels connected together by a rear axle;

a frame connected to each of the rear axle and the front axle through at least one connecting member, the frame comprising:

a handle;

a first lower parallel member and an opposing second lower parallel member, wherein the first and second lower parallel members are interconnected by a first plurality of opposing end tubes;

a first plurality of upright tubes extending vertically from the first lower parallel member to a first upper parallel member and a second plurality of upright tubes extending vertically from the second lower parallel member to a second upper parallel member; and a second plurality of opposing end tubes interconnecting the first upper parallel member with the second upper parallel member;

a first arm mounted to a joint, wherein the joint is rotatably mounted to one of the first plurality of upright tubes;

at least one spray tube removably mounted to the first arm, wherein the at least one spray tube is connected to a manifold mounted to the first upper parallel member via at least one hose;

at least one spray tip connected to the at least one spray tube;

a second arm pivotally mounted to the first lower parallel member; and a roller axle connected to the second arm, wherein a roller is rotatably mounted on the roller axle.

2. The assembly of claim 1, wherein each of the rear axle and the front axle has at least one hole configured to receive at least one pin.

3. The assembly of claim 1, further comprising a cross member extending between and connected to the first upper parallel member and the second upper parallel member.

4. The assembly of claim 1, wherein the manifold comprises a valve, and wherein the valve is connected to a hose.

5. The assembly of claim 3, wherein the handle includes a pair of extending members mounted to the cross member.

6. The assembly of claim 1, further comprising at least one stabilizer positioned on the first arm.

7. The assembly of claim 6, wherein the at least one stabilizer comprises at least one adjustable boom.

8. The assembly of claim 1, further comprising a windscreen selectively attached to the first arm, wherein the windscreen fully surrounds the at least one spray tip.

9. The assembly of claim 1, further comprising a battery attached to the frame.

10. The assembly of claim 1, further comprising an electric motor attached to the frame.

* * * * *